US007259308B2

(12) United States Patent
Geiger

(10) Patent No.: US 7,259,308 B2
(45) Date of Patent: Aug. 21, 2007

(54) ACOUSTIC GUITAR RESONATOR

(76) Inventor: John F. Geiger, 190 Berwick Dr., Atlanta, GA (US) 30328

( * ) Notice: Subject to any disclaimer, the term of this patent is extended or adjusted under 35 U.S.C. 154(b) by 0 days.

(21) Appl. No.: 11/022,432

(22) Filed: Dec. 22, 2004

(65) Prior Publication Data

US 2006/0130632 A1 Jun. 22, 2006

Related U.S. Application Data

(63) Continuation-in-part of application No. 10/459,961, filed on Jun. 12, 2003, now Pat. No. 6,861,581.

(60) Provisional application No. 60/410,696, filed on Sep. 13, 2002.

(51) Int. Cl.
*G10D 3/02* (2006.01)

(52) U.S. Cl. ..... 84/294; 84/294; 84/267; 84/270; 84/291; 84/292

(58) Field of Classification Search ..... 84/267, 84/291, 292, 294, 296
See application file for complete search history.

(56) References Cited

U.S. PATENT DOCUMENTS 548,982 A * 10/1895 van Gelder ..... 84/294
599,814 A * 3/1898 Wachmann ..... 84/294
729,230 A * 5/1903 Smith ..... 84/277
794,333 A * 7/1905 Appelberg ..... 84/294
1,349,700 A * 8/1920 Virzi ..... 84/194
1,461,596 A * 7/1923 Berge ..... 84/270
1,539,961 A * 6/1925 Scott ..... 181/181
2,060,357 A * 11/1936 Williams ..... 84/296
3,314,324 A * 4/1967 Williams ..... 84/294
3,678,794 A * 7/1972 Tansky ..... 84/275
3,956,963 A * 5/1976 Milton ..... 84/296
4,632,003 A * 12/1986 Kopp ..... 84/723
5,567,895 A * 10/1996 Aspri et al. ..... 84/294
5,567,896 A * 10/1996 Gottschall ..... 84/294
5,581,043 A * 12/1996 Bowar ..... 84/291
5,939,652 A * 8/1999 Jones ..... 84/294
6,040,510 A * 3/2000 Yaun ..... 84/294
6,681,661 B2 * 1/2004 Lalonde ..... 84/267
6,861,581 B2 * 3/2005 Geiger ..... 84/294
6,982,372 B2 * 1/2006 England ..... 84/290
7,074,992 B2 * 7/2006 Schmidt ..... 84/294
7,145,064 B2 * 12/2006 Geiger ..... 84/294
2004/0050236 A1 * 3/2004 Geiger ..... 84/294
2006/0130632 A1 * 6/2006 Geiger ..... 84/294

* cited by examiner

*Primary Examiner*—Linconln Donovan
*Assistant Examiner*—Robert W. Horn
(74) *Attorney, Agent, or Firm*—Harry I. Leon; Vivian L. Steadman

(57) ABSTRACT

A resonator assembly includes a resonator, a collector-amplifier, as well as a timbre tray, one or more timbre pieces, and a detector holder. The resonator assembly, designed to be attachable to a conventional acoustic guitar, improves the quality and volume of the conventional guitar. A wood or metal timbre piece or a varying combination thereof may be used according the user's sound preference. The resonator, the collector-amplifier, the timbre holder tray and the detector holder are preferably made from thin brass.

20 Claims, 6 Drawing Sheets

ACOUSTIC GUITAR RESONATOR

CROSS REFERENCE TO RELATED APPLICATIONS

This application is a non-provisional application of U.S. Provisional Application Ser. No. 60/551,243 filed Mar. 5, 2004 and a continuation-in-part of application Ser. No. 10/459,961 filed Jun. 12, 2003, now U.S. Pat. No. 6,861,581 which claims benefit of U.S. Provisional Application Ser. No. 60/410,696 filed Sep. 13, 2002.

FIELD OF INVENTION

The present invention generally relates to stringed musical instruments, such as guitars and banjos, and in particular to a sound resonating and amplifying assembly for acoustic guitars.

BACKGROUND OF THE INVENTION

The traditional, flat-top acoustic guitar has many shortcomings despite of its immense popularity throughout the world. Some of the shortcomings are (1) low volume, (2) difficulty in achieving balanced sound, (3) the cost of a guitar with outstanding sound, (4) limited control available to the guitarist, and (5) the inverse relationship between the sound quality and volume.

While electronic amplification is possible, many guitarists appreciate and would like to own a good sounding, entirely acoustic guitar capable of great volume. In fact, there are very large guitars capable of producing loud volume; however, these are awkward to hold and play. There is a need for a guitar capable of producing quality sound at high volume, without the awkwardness accompanying very large guitars.

Conventional guitars are made to produce balanced sound for notes between the lowest fundamental tone input E2 (82.41 cycles per second, hereinafter "cps") to the highest fundamental tone input B6 (1,975.53 cps). In general, guitars with the richest and most pleasing low pitch tones often do not have the most pleasing high pitch tones, and vice versa. Some attempts to solve this problem include the use of internal resonant sound chambers, as well as internal and external metal resonating cones in so called "resonator guitars". This problem, however, has not been satisfactorily resolved as evidenced by the lack of no dominant resonant guitar type in the market. There is a need for a guitar capable of producing quality sound throughout its entire frequency range.

An inexpensive guitar with a plywood veneer top and poor sound quality can be obtained for about fifty dollars ($50.00). However, guitars with outstanding sound quality can cost many hundreds and thousands of dollars; such guitars often require fine craftsmanship and materials which are often rare and expensive. There is a need for an inexpensive acoustic guitar capable of producing quality sound.

A guitarist has limited control over an acoustic guitar's volume or its characteristic sound or timbre (hereinafter "timbre"). The guitarist may strike the strings nearer the bridge for brighter sound, use a thick pick and strike the strings harder for greater volume, and/or use strings of different gauges and materials for increased resonance and different timbre. Many guitarists often have several guitars for different qualities they seek at different times. There is a need for a guitar capable of allowing the guitarist to easily achieve different levels of volume and different sound characteristics while using the same guitar.

SUMMARY OF INVENTION

The present invention discloses improved embodiments for increasing the sound quality and volume of a conventional acoustic guitar.

A resonator assembly according to the present invention includes a resonator and a collector-amplifier. The resonator, preferably made from thin brass, has a center section having four sides and four arms extending from each side of the center section. One of the four arms further extends to three prongs, one upper and two under prongs, which are used to clip or attach the resonator to an edge of the guitar's sound hole. In general, the upper prong is placed above the guitar's top surface and the two under prongs are placed beneath the guitar's top surface, thereby attaching on the guitar body by holding an edge of the guitar as a wedge between them. Accordingly, when in use, the resonator partially covers the sound hole and is attached cantilevered to an edge of the sound hole. The arm opposite to the arm with the three prongs is designed to include two vibrators. In addition, each of the four arms defines at least one plate hole to further enhance the resonation and amplification of the guitar sound.

The collector-amplifier, also preferably made from thin brass, has a substantially square shaped collector center section. Four arms, one trapezoidal and three rectangular, extend from each of the four sides of the collector center section. When in use, the rectangular arm opposite of the trapezoidal arm is placed at or near the edge of the guitar's sound hole. A dimple or dent (hereinafter a "dimple") is defined in each rectangular arm that is not the trapezoidal arm or the rectangular arm placed near the edge of the sound hole. The dimple is designed to facilitate a better contact between the collector-amplifier and the upper surface of the guitar top and to allow the corresponding rectangular arms to vibrate and do not rub against the upper surface of the guitar top. Furthermore, the trapezoidal arm is slightly bent upward from its mid-length section to the edge distal from the collector center section so that it also vibrates and do not rub against the upper surface of the guitar top. In addition to copying and amplifying the guitar sound, the collector-amplifier protects the upper surface of the guitar top by being placed beneath the upper prong of the resonator.

In the preferred embodiment, the resonator assembly according to the present invention also includes a timbre tray, one or more timbre pieces, and a detector-end holder placed generally above the center section of the collector-amplifier and beneath the detector-end of the upper prong. The detector-end of the upper prong, also referred to as an upper detector-end, is formed by bending in a slanted way the end of the upper prong distal from the center section of the resonator. Similarly, the ends of the two under prongs distal from the center section of the resonator are bent slanted and form a corresponding under detector-end. The under detector-ends make contacts with the underneath surface of the guitar top.

In the preferred embodiment, a timbre tray is placed on the center section of the collector-amplifier, and receives one or more timbre pieces. Thereafter a detector holder having a dimple in the middle thereof is placed to receive the detector end of the upper prong. The timbre pieces are made from wood veneer, such as maple and mahogany, and as well as metal, such as thin brass and thin steel. The timbre tray and the detector holder are preferably made from thin brass.

DETAILED DESCRIPTION OF THE PREFERRED EMBODIMENT

Figure 1:
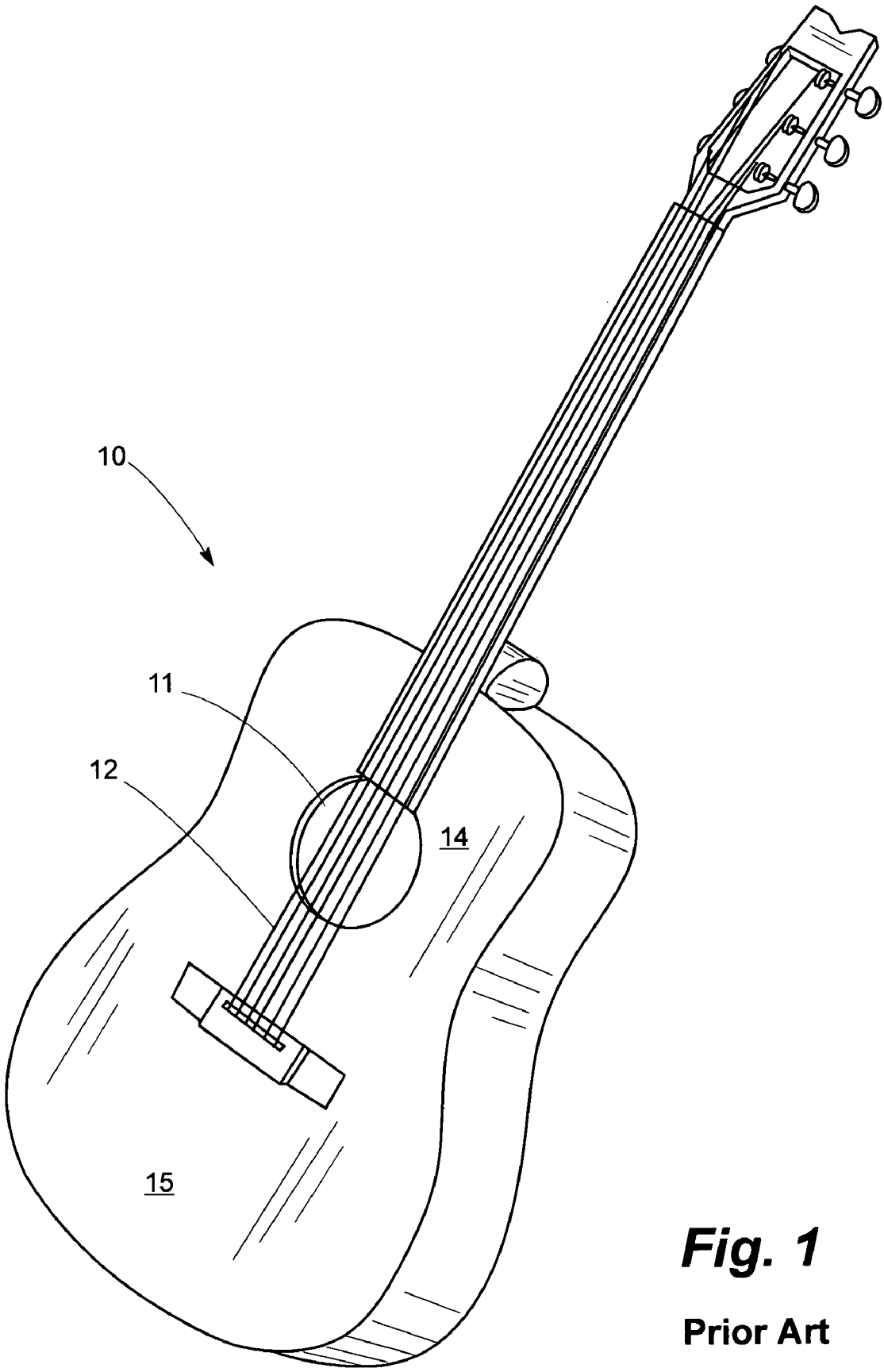
Fig. 1 Prior Art
FIG. 1 is a perspective view of a conventional acoustic guitar.

FIG. 1 illustrates conventional guitar 10 having guitar top 15 defining sound hole 11, and a plurality of strings 12. The areas immediately next to sound hole 11 and generally referred to by reference number 14 are small but active areas of sound on guitar top 15. When guitar 10 is played, surface acoustic waves (composite waves of a plurality of different frequencies) travel on the top and underneath surfaces of guitar top 15, and in particular, rich harmonics which are essential for quality sounds are found in areas 14.

The resonator assembly, devices and methods according to the present invention provide means to detect, copy, modify, amplify and route the surface acoustic waves on areas 14 of guitar top 15 so as to enable the guitarists to obtain quality sound, high volume, and different timbre from a conventional acoustic instrument, such as guitar 10. The present invention achieves the desired results by manipulating and utilizing well known characteristics of sound propagation, such as constructive interference, reflection and diffraction, and positive feedback of sound waves. For additional and supplemental descriptions relating to use of resonator devices with conventional acoustic guitar and theories on copying and amplifying sound waves, refer to co-pending application Ser. No. 10/459,961 filed Jun. 12, 2003, which is hereby incorporated by reference.

Figure 2A:
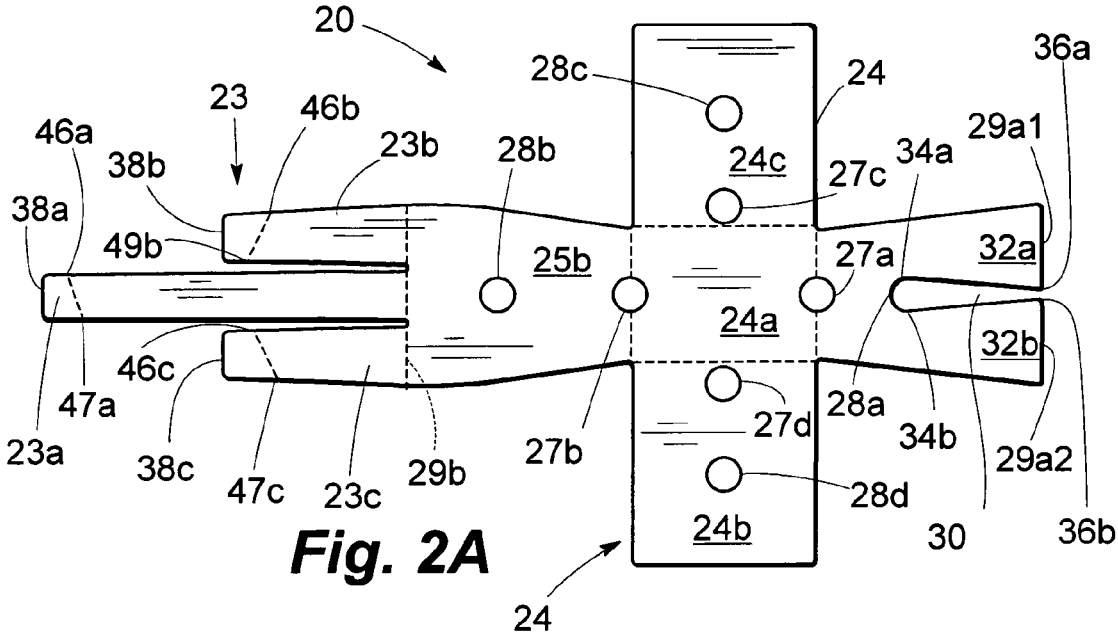
FIG. 2*a* illustrates a top view of the resonator according to the present invention when it is laid flat.

Referring to FIG. 2*a*, resonator 20 comprises a center section 24*a* having four sides and cantilevered arms 24*b*, 24*c*, 25*a*, 25*b* extending from each side of the center section. Arms 25*a* and 25*b* are generally shaped as trapezoids. However, at an edge 29*b* of arm 25*b* are attached or extend three pronged detector arm 23, comprising an upper prong 23*a*, a first under prong 23*b* and a second under prong 23*c*. Furthermore, a part of arm 25*a* is removed and defines channel 30, thereby forming a first and a second vibrator 32*a* and 32*b*.

In the preferred embodiment, center section 24*a* and arms 24*b* and 24*c* are equally sized one (1) by one (1) inch squares, and arms 24*b* and 24*c* extend from the opposite sides of the center section 24*a*. Accordingly, arms 24*b* and 24*c* and center section 24*a* form rectangle 24, whose width and length are one (1) and three (3) inches, respectively.

In the preferred embodiment, arms 25*a* and 25*b* are generally shaped as trapezoids and extend from the opposite sides of the remaining two sides of the center section 24*a*. The narrower bases of arms 25*a*, 25*b* are congruous to and centered about the sides of the center section 24*a* from which they extend and are about three-fourth (¾) of an inch. The width of the wider bases of the trapezoidal arms 25*a*, 25*b* is about one (1) inch. The height of arm 25*b*, that is, from the edge of the center section 24*a* from which arm 25*b* extends to edge 29*b*, the distal edge of arm 25*b*, is about one and one-fourth (1¼) of an inch. The height of arm 25*a*, that is, from the edge of the center section 24*a* from which arm 25*a* extends to edge 29*a*, the distal edge of arm 25*a*, is about one and one-fourth (1 ¼) of an inch.

In the preferred embodiment, each arm, 24*b*, 24*c*, 25*a* and 25*b*, defines plate-holes, 27 and 28, whose diameter is about three-sixteenth (3/16) of an inch. The center of the plate-holes defined by arms 24*b*, 24*c*, i.e., plate-holes 27*c*, 27*d*, 28*c*, 28*d*, align on the longitudinal axis of rectangle 24, while the centers of the plate-holes defined by arms 25*a*, 25*b*, i.e., plate-holes 27*a*, 27*b*, 28*a*, 28*b*, align on the transversal axis of rectangle 24. The center of plate-holes 27*a*, 27*b*, 27*c* and 27*d* are also placed at the edges of the center section 24*a* from which the arms extend. The centers of plate holes 28*c* and 28*d* are placed at about one half (½) of an inch from the centers of the plate holes 27*c* and 27*d*, respectively; and the centers of plate holes 28*a* and 28*b* are placed at about three-fourth (¾) of an inch from the centers of plate holes 27*a* and 27*b*, respectively. In addition, center hole 28*a* is included in channel 30 defined by arm 25*a*, that is, channel 30 is formed by removing the section of arm 25*a* formed by extending the points 34*a* and 34*b* on the edge of hole 28*a* to points 36*a* and 36*b* on edge 29*a* of arm 25*a*, the edge distal from the side of the center section 24*a* from which arm 25*a* extends. In the preferred embodiment, the first vibrator 32*a* has an edge 29*a*1 having a width of thirteenth of thirty-seconds (13/32) and the second vibrator 32*b* has an edge 29*a*2 having a width of seventeen of thirty-seconds (17/32). Thus, the width of channel 30 at edge 29*a* is one-sixteenth (1/16) of an inch.

In the preferred embodiment according to the present invention, the three prongs of detector arm 23 are used to clip or attach the resonator 20 to an edge of the guitar's sound hole, by placing the under prongs 23*b* and 23*c* below the underneath surface of guitar top 15 and the upper prong 23*a* above the upper surface of guitar top 15. The prongs are preferably placed at or near an edge of the sound hole closest to the lowest bass string of the guitar. See, FIGS. 7*a* through 7*d*.

Referring to FIG. 2*a*, in the preferred embodiment, when the resonator is laid flat, the length of the first and second under prongs 23*b* and 23*c* is about one (1) inch each, and the width of the prongs 23*b* and 23*c* at edges 38*b* and 38*c*, the distal edges from the center section 24*a*, is about one-fourth (¼) of an inch each. The length of the upper prong 23*a* is about two (2) inches when it is laid flat, and the width of the upper prong 23*a* at edge 38*a*, the distal edge from the center section 24*a*, is one-fourth (¼) of an inch. Prongs 23*a*, 23*b*, and 23*c* are separated from each other by one thirty-seconds (1/32) of an inch near edge 29*b*. In addition, each of the side edges of the prongs, 23*a*, 23*b* and 23*c*, tapers evenly so that each prong has a width of about one-fourth (¼) of an inch at edge 38.

Figure 2B:
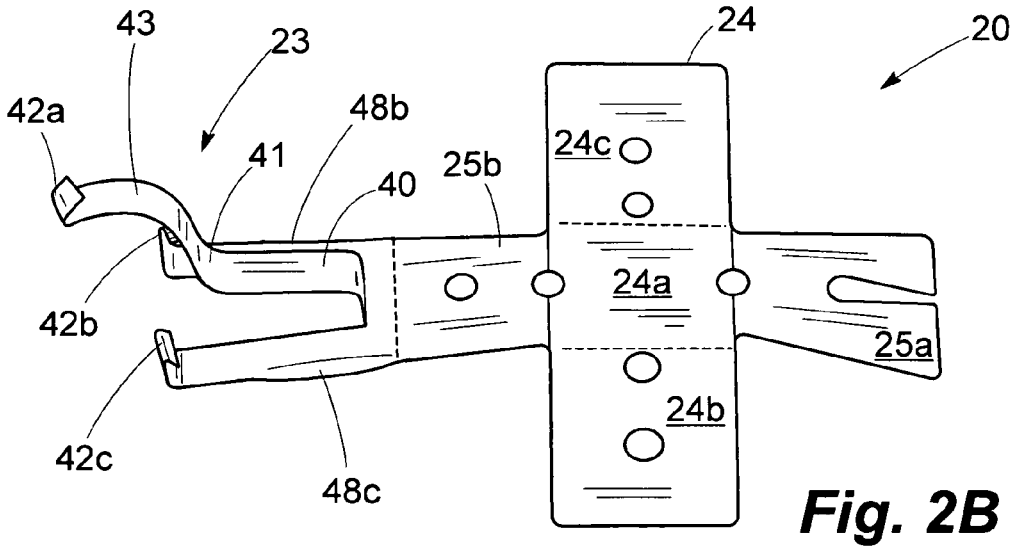
FIG. 2*b* illustrates a perspective view of the resonator according to the present invention.
Figure 2C:
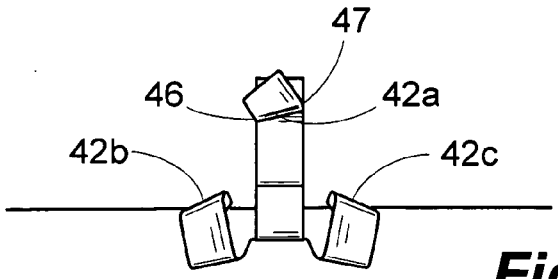
FIG. 2*c* illustrates the detector-ends of the resonator shown in FIG. 2*b*.

Referring to FIG. 2*b*, upper prong 23*a* is bent upward about three-eighth (⅜) of an inch at or near edge 29*b* and then is flat for about three-eighth (⅜) of an inch to reference point 41. Thereafter, prong 23*a* curves upward to a maximum height of about three-eighth (⅜) of an inch at reference point. From point 43, prong 23*a* curves downward and then is bent sharply and slanted to form an upper detector-end 42*a*. Referring to FIGS. 2*a* and 2*c*, the edge 38*a* is bent slanted, that is, a bent is made across points 46*a* and 47*a*. The distance between edge 38*a* and point 46 is about one-sixteenth (1/16) of an inch and the distance between edge 38*a* and point 47 is about three thirty-seconds (3/32) of an inch. Accordingly, upper prong 23*a* is designed to make contacts with a flat surface at two different places, at flat region 40 and at the upper detector-end 42*a*.

In the preferred embodiment, each of under prongs 23*b* and 23*c* is bent downward about three-eighth (⅜) at or near edge 29*b* and then is flat for about three-eighth (⅜) of an inch, shown as referenced points 48*b* and 48*c* on prong 23*b* and 23*c*, respectively. Thereafter, prongs 23*b* and 23*c* are curved upward in a slanted way to form under detector-ends 42*b* and 42*c*, respectively. The distance between edge 38*b* and 46*b* is about one-sixteenth (1/16) of an inch and the distance between edge 38*b* and point 47*b* is about three thirty-seconds (3/32) of an inch. The distance between edge 38*c* and 46*c* is about one-sixteenth (1/16) of an inch and the distance between edge 38*c* and point 47*c* is about three thirty-seconds (3/32) of an inch.

Detector arm 23 is curved and bent as disclosed to efficiently provide the clipping or spring function required to clip or attach the resonator 20 to edge 17 of guitar hole 11 and to efficiently copy the surface acoustic waves from the top and underneath surfaces of guitar top 15. In addition, the slanted and folded edges of the upper and under detector-ends 42*a*, 42*b* and 42*c* blunt the sharpness of the contacts between the surfaces of the guitar top 15 and the detectors-ends. Detector arm 23 may be adjusted by force, such as finger squeeze, as necessary to reacquire the original, intended shape.

Resonator 20 is typically made of a single piece of brass sheet, whose thickness preferably ranges between 0.010 to 0.016 inches. The brass sheet used for resonator 20 is preferably one-half (½) to three-fourth (¾) hard brass typically having a composition of seventy percent (70%) copper (Cu) and thirty percent (30%) zinc (Zn).

Figure 3:
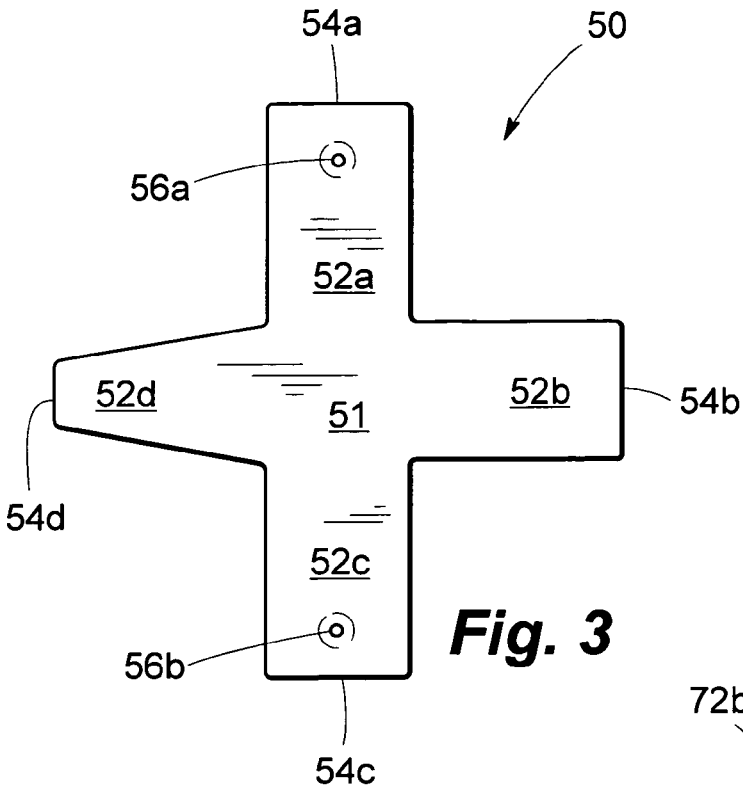
FIG. 3 illustrates a collector amplifier according to the present invention.

Referring to FIG. 3, a collector-amplifier 50 according to the present invention is generally cross-shaped. Collector center section 51 is preferably a square of one-half (½) by one-half (½) inches and have four sides from which extend three rectangular arms 52*a*, 52*b*, and 52*c* and a tapered arm shaped as a trapezoid, 52*d*. In the preferred embodiment, the distance between edges 54*a* and 54*c* is two and one-eighth (2⅛) of an inch, and the distance between edges 54*b* and 54*d* is two and one-eighth (2⅛) of an inch. In addition, dimples 56*a* and 56*b* are made on or defined by arms 52*a* and 52*c*. Dimples 56*a* and 56*b* facilitate better sound copying from the upper surface of guitar top 15 and allow arms 52*a* and 52*c* to vibrate without rubbing against the upper surface. Dimples 56*a* and 56*b* are located about one-fourth (¼) of an inch from their corresponding edges, 54*a* and 54*c*. Furthermore, trapezoidal arm 52*d* is slightly bend upward, for example by one-sixteenth (1/16) of an inch, from its mid-length region to edge 54*d* so that arm 52*d* may also vibrate and does not rub against the upper surface of guitar top 15. Collector-amplifier 50 is typically made of a single piece of brass sheet, whose thickness is preferably about 0.010 inches and preferably has a composition of 70 percent copper and 30 percent zinc.

Figure 4:
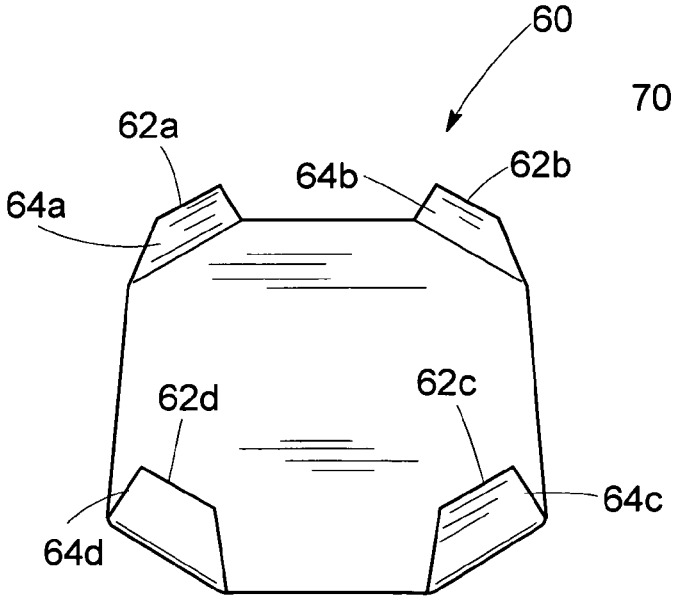
FIG. 4 illustrates a timbre tray according to the present invention.

Referring to FIG. 4, a timbre tray 60 according to the present invention is preferably formed from a square of one and one-fourth (1¼) inches. First, for safety reasons, the four corner tips of the square are nipped off such that each resulting width of the four nipped edges, 62*a* through 62*d*, is preferably about one-sixteenth (1/16) of an inch. Thereafter, the four nipped corners are bent upward at a ninety (90) degree to form timbre tray 60. Each height of the bent corners, 64*a* through 64*d*, is about one-eighth (⅛) of an inch. These preferred dimensions allow a stack of up to four or five timbre pieces to be placed in the timbre tray. Timbre tray 60 is preferably made from thin brass.

Figure 5A:
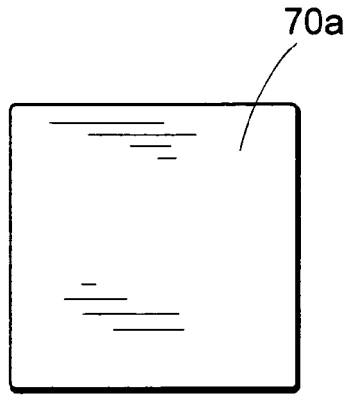
FIGS. 5A and 5B illustrates timbre pieces 70 according to the present invention.
Figure 5B:
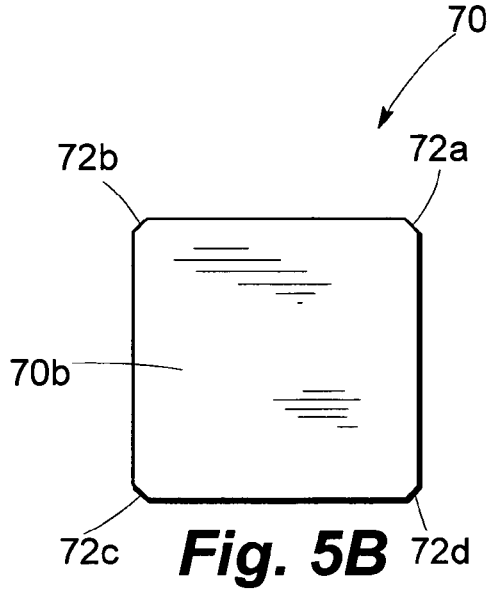

Referring to FIGS. 5A and 5B, a plurality of timbre pieces 70 is illustrated. Timbre piece 70*a* is preferably made of wood veneer, such as maple and mahogany, and is preferably about one by one (1×1) square inches. Timbre piece 70*b* is made of thin metal, such as brass and general purpose carbon steel shim stock, and is preferably a one by one (1×1) square, with its four corners nipped off to from corresponding edges (72*a* through 72*d*) of one-sixteenth (1/16) of an inch. These preferred dimensions for timbre pieces 70 allow them to fit loosely on timbre tray 60 disclosed herein. A brass timbre piece is made from 0.010 inch thick brass, and a steel timbre pieces is made from 0.007 inch thick steel.

Depending on the sound preference of the user, none, one or a varying combination of two or more timbre pieces 70 may be placed in timbre tray 60, which is in turn placed above the collector center section 51 of the collector amplifier 50 and beneath the detector-end 42*a* of the upper prong 23*a*. Obviously, the user may only use resonator 20 and collector-amplifier 50 without the timbre tray and timbre pieces.

Figure 6:
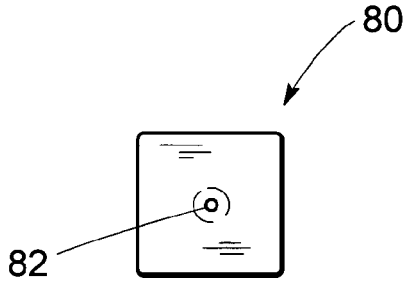
FIG. 6 illustrates a detector holder according to the present invention.

Referring to FIG. 6, detector holder 80 according to the present invention is preferably a one-half by one-half (½×½) brass square piece with a dimple 82 in the middle thereof. Dimple 82 in the detector holder 80 helps to receive or keep in place the detector-end 42*a* of the upper prong 23*a*. When one or more timbre pieces 70 are used, detector holder 80 is placed on the top of the last timbre piece placed in timbre tray 60. When only resonator 20 and collector-amplifier 50 are used, detector holder 80 may be placed above the collector-amplifier and beneath detector-end 42*a* of the upper prong 23*a*. If a combination of resonator 20, collector amplifier 50, and timbre tray 60 is used, detector holder 80 may be placed above timbre tray 60 and beneath detector-end 42*a* of the upper prong 23*a*.

Figure 7A:
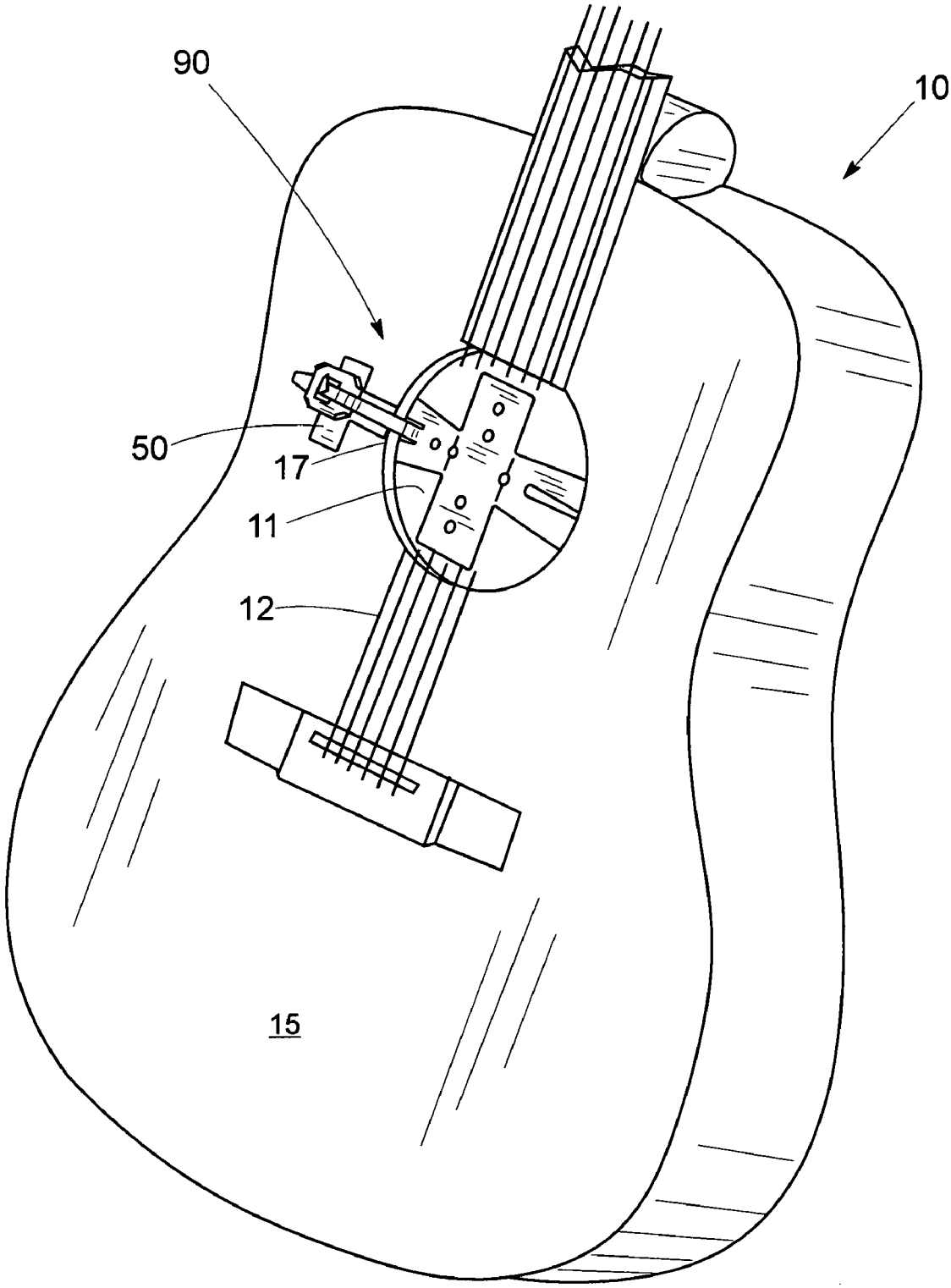
FIG. 7*a* illustrates a resonator assembly according to the present invention being used with a conventional guitar.
Figure 7B:
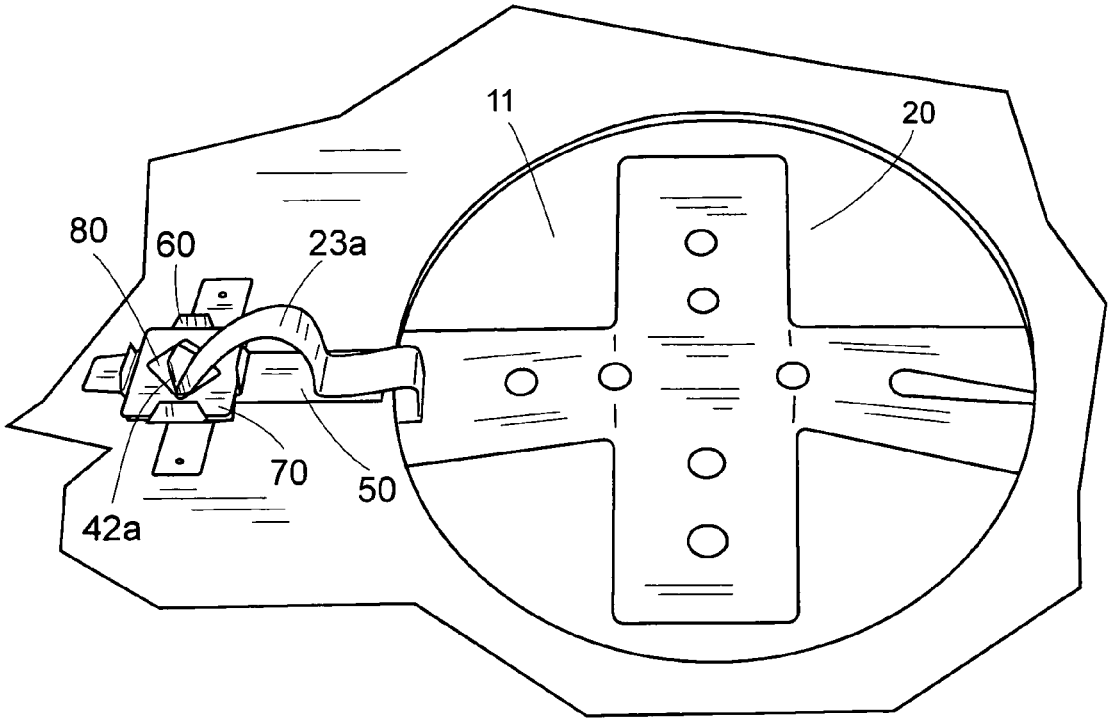
FIG. 7*b* is the perspective top view of FIG. 7*a* near the guitar hole.
Figure 7C:
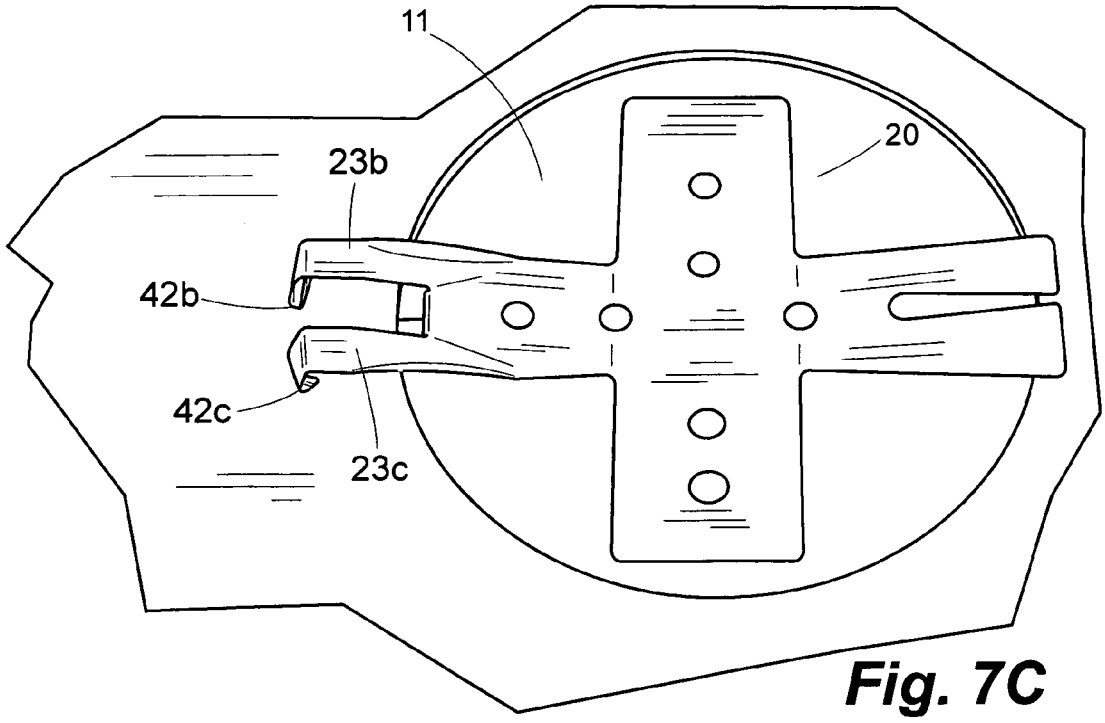
FIG. 7*c* is the perspective bottom view of FIG. 7*a* near the guitar hole.
Figure 7D:
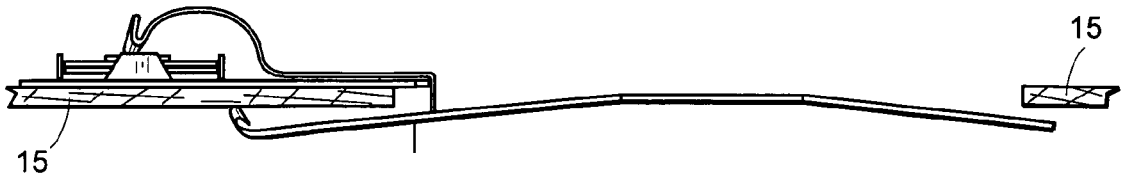
FIG. 7*d* is the perspective side view of FIG. 7*a* near the guitar hole.
Figure 8:
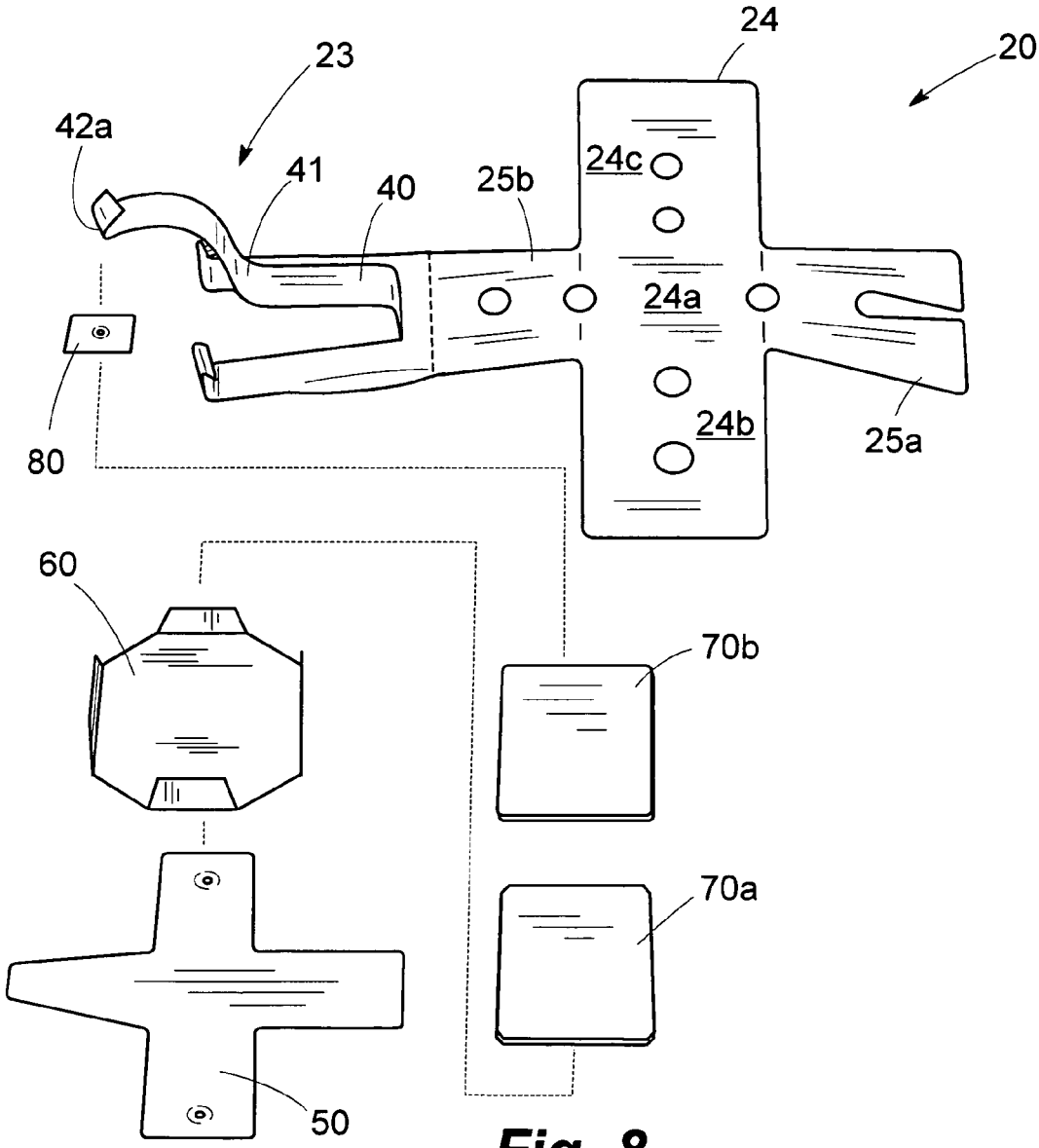
FIG. 8 is an exploded view of the resonator according to the present invention.

Referring to FIG. 7*a*, a resonator assembly 90 according to the present invention is attached to a conventional acoustic guitar 10. Resonator 20 is placed cantilevered at or near edge 17 defining sound hole 11, thereby partially covering sound hole 11. In general, the user places the four arms of resonator 20 underneath guitar strips 12 and clips or attaches resonator 20 to edge 17 using the spring or clipping function of the upper and under prongs, 23*a*, 23*b* and 23*c*.

Before placing the upper prong 23*a* directly on the upper surface of guitar top 15, collector-amplifier 50 is slid under the upper prong and is placed on the upper surface of the guitar top 15. The collector-amplifier is placed on guitar top 15 such that edge 54*b* of collector-amplifier 50 is at or near edge 17. When additional pieces of the present invention, such as timbre tray 60 and one or more timbre pieces 70 are used, timbre tray 60 is placed above collector-amplifier 50. Timbre tray 60 is preferably centered about the collector center section 51. Again, depending on the user's sound preference, one or more timbre pieces 70 may be placed inside timbre tray 60. Thereafter, detector holder 80 is placed about the center of the timbre piece(s) 70. (See, FIG. 7*b*). The under prongs 23*b* and 23*c* are shaped such that: first, they bend downward about three-eighth (3/8) of an inch; second, they are placed substantially flat below the underneath surface of guitar top 15 for about three-eighth (3/8) of an inch; and third, under detector-ends 42*b* and 42*c* make contacts with the underneath surface of guitar top 15. (See FIG. 7*c*). Thus, according to the present invention, on the underside of the guitar top 15, only the detector-ends 42*b* and 42*c* touches the under surface of guitar top 15. (See FIGS. 7*a* through 7*d*).

Numerous modifications to and alternative embodiments of the present invention will be apparent to those skilled in the art in view of the foregoing description. Accordingly, this description is to be construed as illustrative only and is for the purpose of teaching those skilled in the art the best mode of carrying out the invention. Details of the embodiment may be varied without departing from the spirit of the invention, and the exclusive use of all modifications which come within the scope of the appended claims is reserved.

What is claimed is:

1. A resonator for use with an acoustic guitar having a plurality of strings and a guitar top defining a sound hole, said guitar top having upper and underneath surfaces, comprising:

a center section having four sides, a first and a second rectangular arms extending from two opposite sides of the center section;

a trapezoidal arm extending from a third side of the center section and three prongs extending from an edge of the trapezoidal arm distal from the third side of the center section; and a fourth arm extending from the fourth side of the center section, the fourth arm further comprising two vibrators.

2. The resonator according to claim 1, wherein the resonator is made from brass.

3. The resonator according to claim 1, wherein each of the first, second, trapezoidal and fourth arms defines at least one plate-hole.

4. The resonator according to claim 1, wherein the three prongs comprises an upper prong which is placed above the upper surface of the guitar top and two under prongs which are placed on the underneath surface of the guitar top when the resonator is in use.

5. The resonator according to claim 4, wherein the end of the upper prong is bent to form an upper detector-end and each end of the under prongs is bent to form a corresponding under detector-end.

6. The resonator according to claim 1, wherein the two vibrators are formed by a channel defined by the fourth arm, the channel extending from an edge of the fourth arm distal from the fourth side of the center section to a section within the fourth arm.

7. A collector-amplifier for use with an acoustic guitar having a plurality of strings and a guitar top defining a sound hole, said guitar top having upper and underneath surfaces, comprising:

a collector center section substantially shaped as a square having four sides;

a first and a second rectangular arms extending from two opposite sides of the collector center section and each of the first and second rectangular arms defining a dimple;

a third rectangular arm extending from the third side of the collector center section; and a trapezoidal arm extending from the remaining side of the collector center section.

8. The collector-amplifier according to claim 7, wherein the collector-amplifier is made from brass.

9. The collector-amplifier according to claim 7, wherein each dimple defined by the first and second rectangular arm is located about one-fourth of an inch from the corresponding edge of the rectangular arm distal from the collector center section.

10. A resonator assembly for improving sound quality of an acoustic guitar having a plurality of strings and a guitar top defining a sound hole, said guitar top having upper and underneath surfaces, comprising:

a resonator comprising a center section having four sides; a first, a second, a third, and a fourth arms extending from each of the four sides of the center section; the third arm further extending to an upper prong and two under prongs; and the fourth arm further comprising two vibrators;

a collector-amplifier having a substantially square collector center section; a first, a second and a third rectangular arms extending from three sides of the collector center section; and a trapezoidal arm extending from the remaining side of the collector center section and opposite from the third rectangular arm; wherein the upper and the two under prongs are used to clip the resonator to an edge of the guitar top defining the sound hole and the collector-amplifier is placed on the upper surface of the guitar top near the sound hole and beneath the upper prong of the resonator.

11. The resonator assembly according to claim 10, wherein the resonator and the collector-amplifier are made from brass.

12. The resonator assembly according to claim 10, wherein the edge of the third arm of the collector-amplifier is placed near the edge of the sound hole; the upper prong comprising an upper detector-end making a contact with the collector center section of the collector-amplifier; and each of the two under prongs being placed beneath the undersurface of the guitar top and comprising a corresponding under detector-end making a contact with the underneath surface of the guitar top.

13. The resonator assembly according to claim 10, further comprising a detector holder which is substantially square-shaped and is placed above the collector-amplifier and beneath a detector end of the upper prong.

14. The resonator assembly according to claim 13, further comprising a timbre tray placed above the collector center section of the collector-amplifier and beneath the detector holder.

15. The resonator assembly according to claim 14, further comprising at least one timbre piece placed above the timbre tray and beneath the detector holder.

16. The assembly according to claim 14, wherein the detector end holder and the timbre tray are made from brass.

17. The assembly according to claim 15, wherein the timbre piece is made from wood veneer.

18. The assembly according to claim 15, wherein the timbre piece is made from brass.

19. The assembly according to claim 15, wherein the timbre piece is made from steel.

20. The assembly according to claim 13, wherein the detector holder defines a dimple for receiving the detector end of the upper prong.

* * * * *